US005133307A

United States Patent [19]

Kurihara

[11] Patent Number: 5,133,307

[45] Date of Patent: Jul. 28, 1992

[54] AIR INTAKE SYSTEM FOR MARINE PROPULSION UNIT ENGINE

[75] Inventor: Noboru Kurihara, Hamamatsu, Japan

[73] Assignee: Sanshin Kogyo Kabushiki Kaisha, Hamamatsu, Japan

[21] Appl. No.: 610,375

[22] Filed: Nov. 6, 1990

[30] Foreign Application Priority Data

Nov. 8, 1989 [JP] Japan ..... 1-290316

[51] Int. Cl.[5] ..... F02B 25/28; F02B 75/20

[52] U.S. Cl. ..... 123/52 M; 123/52 MV; 123/59 B; 123/73 A

[58] Field of Search ..... 123/52 M, 59 B, 73 R, 123/73 A, 73 C, 52 MV

[56] References Cited

U.S. PATENT DOCUMENTS 4,227,492 10/1980 Haase ..... 123/73 A X
4,702,202 10/1987 Hensel et al. ..... 123/52 M
4,955,341 9/1990 Trombley et al. ..... 123/73 C X

*Primary Examiner*—Tony M. Argenbright
*Attorney, Agent, or Firm*—Ernest A. Beutler

[57] ABSTRACT

An air intake system for a marine propulsion engine having a U shaped configuration for facilitating water separation and to provide a long intake passage. An air flow sensor is positioned at the inlet opening of the inlet device with the length between the inlet opening and the intake ports being effective to dampen pulsations in the induction system from the air flow device.

39 Claims, 3 Drawing Sheets

AIR INTAKE SYSTEM FOR MARINE PROPULSION UNIT ENGINE

BACKGROUND OF THE INVENTION

This invention relates to an air intake system for a marine propulsion unit engine and more particularly to an improved induction system for such engines that insures against water ingestion to the engine and which permits the use of an air flow sensor without increasing the volume of the engine.

It is well known that many marine propulsion units are propelled by internal combustion engines. This is particularly true with respect to outboard motors wherein an internal combustion engine is positioned in the power head for driving a propulsion unit of the lower unit of the outboard motor. Conventionally, the intake passages for the engine are served by horizontally extending intake manifolds. This type of arrangement is employed regardless of whether the engine operates on the two stroke principle, as is more common, or on the four stroke principle.

Generally, because of the marine environment, the air is drawn directly from the atmosphere through the outer cowling and through an air silencing device positioned within the inner cowling. However, the horizontal disposition of the intake passages and the fact that the engine operates in a marine environment gives rise to the problem of ingestion of water into the engine combustion chambers during operation.

Although various water separation devices have been employed to avoid this problem, the water separators are normally provided in the outer cowling. That is, the induction system of the engine itself normally does not employ any water separation arrangement. It is, therefore, a principal object of this invention to provide an air intake system for a marine propulsion unit engine that includes an integral water separator.

It is a further object of this invention to provide an air intake system for a marine propulsion engine that is configured in such a way to insure that water will not enter the combustion chambers of the engine.

It is a further object of the invention to provide an improved and compact air intake system for an engine that includes a water separation arrangement.

In connection with engines and particularly those for marine application, it has been recently proposed to use fuel injection for the engine. The fuel injection system normally includes some form of air flow measuring device, either of the speed density type or of the mass flow type. With a speed density type, the engine can be quite compact in construction and a separate sensor can be provided for each cylinder. However, since the air flow is indirectly measured through suction pressure, the accuracy is low, particularly at low air flows and the air fuel ratio cannot be accurately controlled.

With a mass flow type, on the other hand, the air flow can be measured accurately, but the flow sensor generally is rather large and can add to the bulkiness of the engine construction. This is particularly true when the sensor is mounted on the induction system and externally of the engine, as is normally done. With such an arrangement, this can not only provide problems with space for an individual engine, but it can restrict the maneuverability of the associated watercraft if plural outboard motors are employed on a single boat. That is, if the cowling is sized so as to clear the air flow sensor, then the turning or steering movement of the outboard motors may be restricted.

It is, therefore, a still further object of this invention to provide an improved and compact arrangement for sensing the air flow to an engine without increasing significantly upon its bulk.

SUMMARY OF THE INVENTION

A first feature of this invention is adapted to be embodied in an air induction system for a marine propulsion engine having at least one horizontally extending intake port. The induction system comprises a first generally vertically extending inlet passage having an inlet opening at its upper end for receiving atmospheric air. A second generally vertically extending inlet passage communicates at an upper portion thereof with the intake port. A U shaped section interconnects the lower ends of the inlet passages with each other.

Another feature of the invention is adapted to be embodied in an air flow sensing device for a marine engine having at least one horizontally extending intake port. An induction passage extends from the intake port to a position in proximity to the engine and an air flow sensor is provided at the inlet to this section.

DETAILED DESCRIPTION OF THE PREFERRED EMBODIMENT OF THE INVENTION

Figure 1:
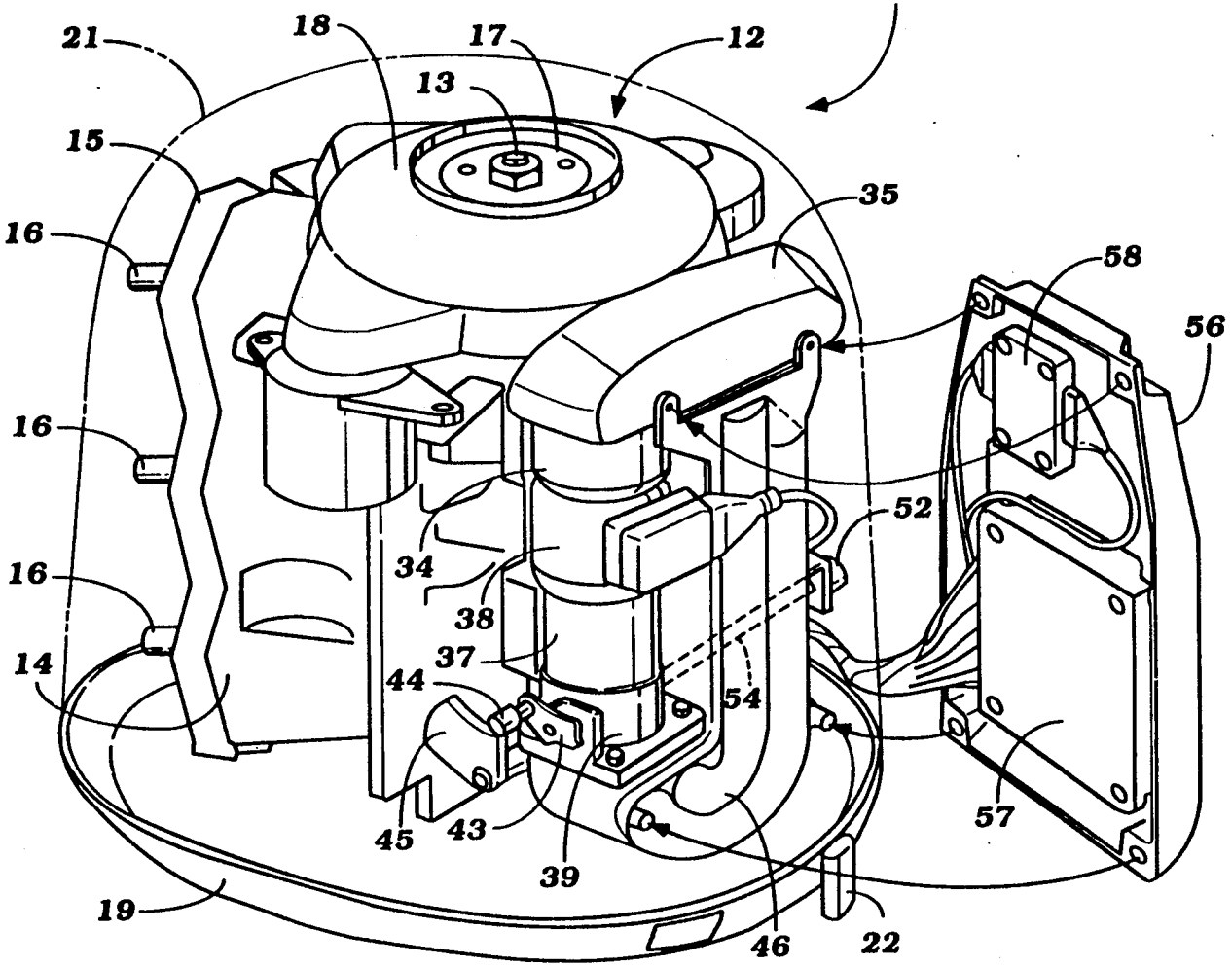
FIG. 1 is a partial, partially exploded view of the power head of an outboard motor constructed in accordance with a first embodiment of the invention.

Referring first to FIG. 1, an outboard motor constructed in accordance with an embodiment of the invention is shown partially and is identified generally by the reference numeral 11. The invention is described in conjunction with an outboard motor, since the invention has particular utility in such applications. It is to be understood, however, that certain facets of the invention can be employed with other applications for marine propulsion.

The outboard motor 11 includes an internal combustion engine, which is indicated generally by the reference numeral 12 and which, in the illustrate'embodiment, is of the two cycle crankcase compression type. The engine 12 is depicted as being of a V-6 configuration. It is to be understood, however, that the invention can be employed in conjunction with engines operating on other than the two stroke principle, non reciprocating engines, and also engines having other numbers of cylinders and cylinder orientation. However, the invention does have particular utility in conjunction with the described type of engine.

As is conventional with outboard motor practice, the engine 12 is positioned with its crankshaft 13 rotating about a vertically extending axis. A pair of angularly disposed cylinder banks 14, only one of which appears in FIG. 1, radiate from a crankcase in which the crankshaft 13 rotates and are each formed with three aligned cylinder bores. A cylinder head 15 is affixed to each cylinder bank 14 and contains spark plugs 16 for firing the charge therein. An ignition system, to be referred to later, is provided for firing a spark plug 16. This ignition system includes a flywheel magneto 17 that is affixed to the upper end of the crankshaft 13 and which is contained within an internal protective cowling 18.

The power head of the outboard motor 11 is completed by a lower tray 19 that is affixed to the underside of the engine 12 and a main cowling member, shown in phantom and identified by the reference numeral 21. The main cowling member 21 is detachably affixed to the tray 19 by means including latches 22, only one of which appears in the drawings.

Since the invention deals with the induction system for the engine 12 rather than the internal construction of the engine, further or detailed description of the engine per se is not believed to be necessary to understand the invention. However, it should be noted that the crankshaft 13 of the engine is positioned in a forwardly facing direction and the crankcase chambers in which the crankshaft 13 rotates are disposed vertically as seen at 23 in FIG. 3. As is well known, the crankcase chambers 23 associated with each of the cylinders are sealed relative to each other.

Figure 2:
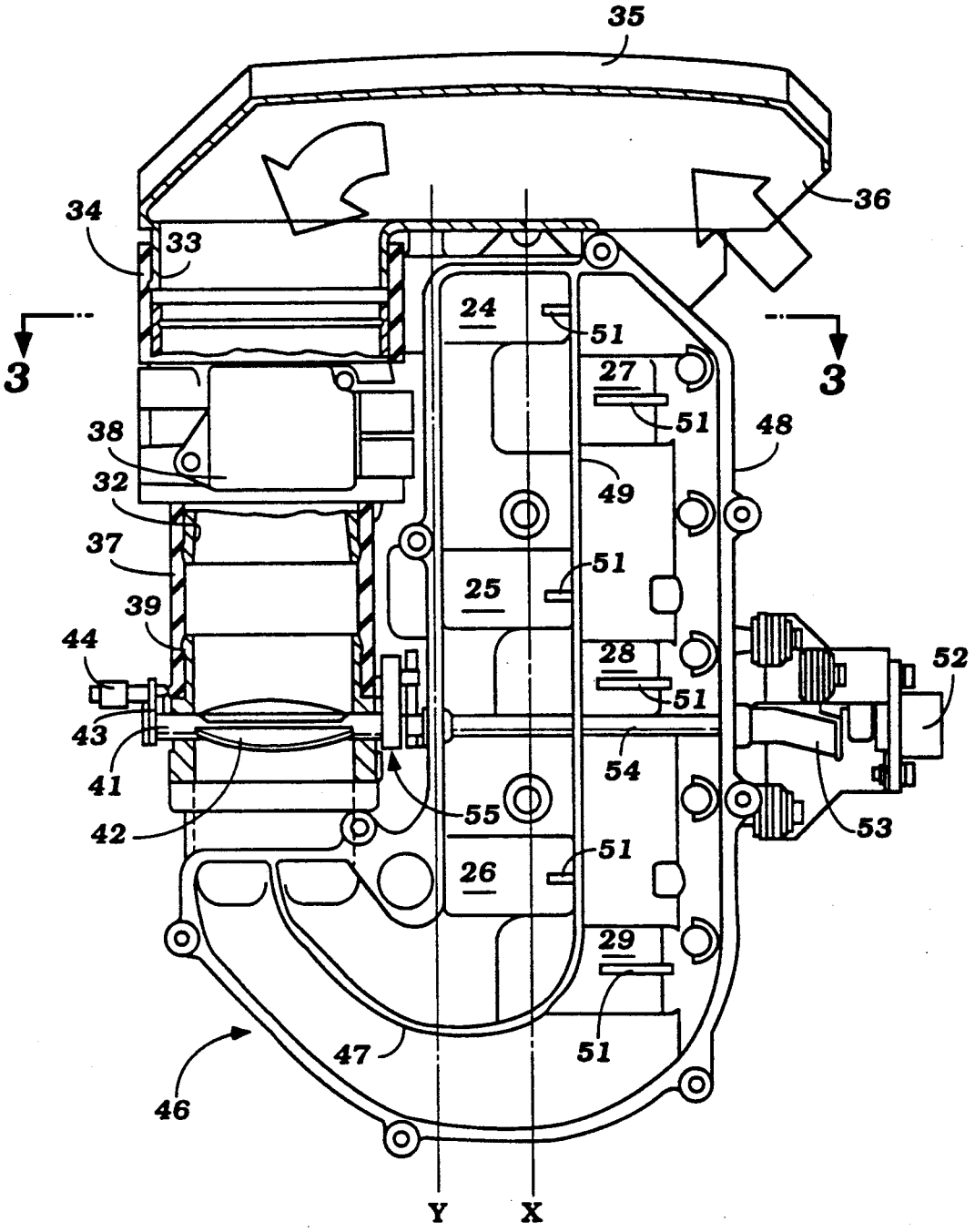
FIG. 2 is a cross sectional view taken through the induction system of the engine along a vertically extending plane as indicated by the section line 2—2 in FIG. 3.
Figure 3:
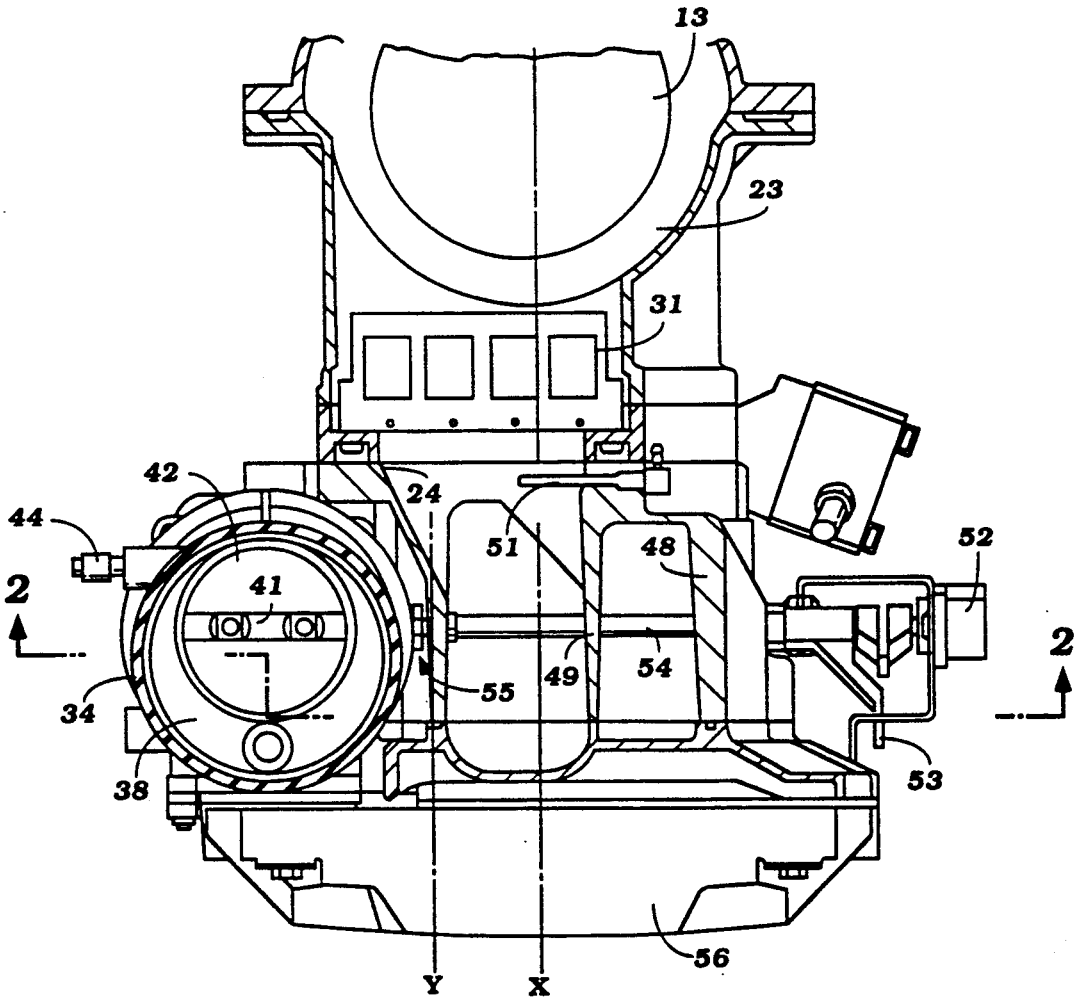
FIG. 3 is a cross sectional view taken along the line 3—3 of FIG. 2.

Referring now additionally and primarily to FIGS. 2 and 3, each crankcase chamber of the engine is provided with a respective intake port 24, 25, 26, 27, 28 and 29 which extend generally horizontally and are disposed in side by side, vertically spaced orientation, as may be best seen in FIG. 2. A reed type check valve, indicated by the reference numeral 31, is disposed at the base of each intake port for precluding reverse flow through the intake ports 24 through 29 when the charge in the crankcase chambers 23 is compressed.

An induction system, now to be described, is provided for delivering an air charge to the intake ports 24 through 29. Basically, this induction system includes a first, generally vertically extending intake passage, indicated generally by the reference numeral 32 and which has an air inlet opening 33 formed at its upper end by an air horn portion 34. This inlet opening 33 communicates with the interior of a generally transversely extending air silencing device, indicated generally by the reference numeral 35 and which has a downwardly facing inlet opening 36 that communicates with the interior of the protective cowling aforedescribed. The protective cowling is, itself, provided with a suitable intake opening which may include a water separator.

The vertically extending intake passage 32 is, in addition to being formed by the air horn 34, is formed by a section 37 in which an air flow sensor 38 of the mass flow type is positioned. It should be noted that the sensor 38 is positioned closely adjacent the air horn 33 and is spaced from the intake ports 24 through 29 so a to be isolated from the pulsations which will occur therein.

A throttle body, indicated generally by the reference numeral 39 is positioned below the air flow sensor 38 and rotatably journals a throttle valve shaft 41 on which a butterfly type throttle valve 42 is affixed. A throttle lever 43 is affixed to the exposed end of the throttle valve shaft 41 and carries a roller type follower 44 that is engaged by a throttle cam 45 which is, in turn, actuated by a remotely positioned throttle operator (not shown) for controlling the speed of the engine, as is well known in this art.

The air inlet device further includes a U shaped section 46 that communicates with the throttle body 39 and which is divided into two portions by means of an inner wall 47. These two portions merge into separate sections of a further vertically extending intake pipe, indicated generally by the reference numeral 48 which is divided itself by an internal wall 49. One section communicates with the intake ports 24, 25 and 26, while the other portion communicates with the intake ports 27, 28 and 29, as clearly shown in the figures. It should be noted that the positioning of the intake system as thus far described places it between the mass of the engine 12 and the occupants of the associated watercraft so as to provide an insulating area for sound deadening purposes. In addition, the U shaped configuration causes any water which might pass into the intake device 35 to accumulate at the lower portion of the U shaped section 46 and be separated without passing into the intake ports 24 through 29. Also, as has been previously noted, the length of the induction system separates the air flow sensor 38 a substantial distance upstream from the ports 26 through 29 so as to provide pulsation damping.

Injection nozzles 51 are mounted in the induction system and each sprays fuel into the respective intake port 24 through 29.

The control for the engine also includes a throttle position sensor 52 that is mounted on the side of the induction system opposite to the linkage that operates the throttle valve 41. A wiper arm 53 of this sensor is affixed to a shaft 54 that extends through the induction system section 48 and which is coupled to the throttle valve shaft 41 through a suitable motion transmitting connection 55 that will accommodate some axial misalignment, while still maintaining good signal transmission.

A cover plate 56 may be affixed to the forward portion of the induction system and can contain controls for the engine such as a CPU 57 which can control the injection system and also a spark controller circuit 58 for controlling the firing of the spark plug 16. This provides a convenient mounting and also permits a compact assembly.

It should be noted that a vertically extending plane containing the axis of rotation of the crankshaft 13 (X) extends partially through the intake section 48 while the intake section 37 is disposed on a side opposite to a second vertically extending plane Y which is defined by the inner end of the section 48. Because of this construction, it is possible to have a very compact engine in the fore and aft direction and still a long induction system for tuning purposes and also, as aforenoted, to isolate the sensor 38 from the intake ports 24 through 29. The intake ports 24 through 29 also can be disposed horizontally so as to improve the flow into the crankcase chambers 23 and the positioning of the inlet device 35 over the induction system further adds to the compactness of the arrangement.

The foregoing description is that of a preferred embodiment of the invention. Various changes and modifications may be made without departing from the spirit and scope of the invention, as defined by the appended claims.

I claim:

1. An induction system for a marine engine having at least one horizontally extending intake port constituting the lowest intake port of said engine in a vertical direction, said induction system comprising a first generally vertically extending inlet passage having an inlet opening at its upper end for receiving atmospheric air, a second generally vertically extending inlet passage communicating at an upper portion thereof with said intake port, and a U shaped section communicating the lower ends of said inlet passages with each other below said intake port.

2. An induction system as set forth in claim 1 further including an air flow meter positioned adjacent the inlet opening of the first inlet passage.

3. An induction system as set forth in claim 1 further including an intake device communicating with the inlet opening and extending across the upper ends of the first and second inlet passages.

4. An induction system as set forth in claim 3 wherein the inlet device has a downwardly facing opening for receiving atmospheric air adjacent the upper end of the second inlet passage.

5. An induction system as set forth in claim 4 wherein there are provided a multitude of inlet ports vertically spaced relative to each other and each communicating with the second inlet passage above said U shaped section.

6. An induction system as set forth in claim 5 wherein the intake ports are all formed at one end of the engine.

7. An induction system as set forth in claim 6 wherein the engine is a two cycle crankcase compression engine.

8. An induction system as set forth in claim 7 wherein the intake ports open into the crankcase chambers of the engine.

9. An induction system as set forth in claim 8 wherein the engine has a V configuration with multiple intake ports for each bank with the intake ports disposed in side by side vertically spaced orientation.

10. An induction system as set forth in claim 1 wherein the engine is provided with a multitude of vertically spaced inlet ports all formed at one end of the engine.

11. An induction system as set forth in claim 10 wherein the engine is a two cycle crankcase compression engine.

12. An induction system as set forth in claim 11 wherein the intake ports open into the crankcase chambers of the engine.

13. An induction system as set forth in claim 12 wherein the engine has a V configuration with multiple intake ports for each bank with the intake ports disposed in side by side vertically spaced orientation.

14. An induction system as set forth in claim 10 further including an intake device communicating with the inlet opening and extending across the upper ends of the first and second inlet passages.

15. An induction system as set forth in claim 1 wherein the second inlet passage is aligned generally with the intake port and the first inlet passage is disposed to one side of the inlet port and said second inlet passage.

16. An induction system as set forth in claim 15 wherein there are provided a multitude of inlet ports vertically spaced relative to each other and each communicating with the second inlet passage.

17. An induction system as set forth in claim 16 wherein the intake ports are all formed at one end of the engine.

18. An induction system as set forth in claim 15 wherein the engine is a two cycle crankcase compression engine.

19. An induction system as set forth in claim 18 wherein there are provided a multitude of inlet ports vertically spaced relative to each other and each communicating with the second inlet passage.

20. An induction system as set forth in claim 19 wherein the intake ports open into the crankcase chambers of the engine.

21. An induction system as set forth in claim 20 wherein the second inlet passage is offset from the center of the intake port in a direction away from the first intake passage.

22. An induction system as set forth in claim 20 wherein the engine has a V configuration with multiple intake ports for each bank with the intake ports disposed in side by side vertically spaced orientation.

23. An induction system as set forth in claim 22 wherein there is provided a vertically extending dividing wall extending at least in part through the second inlet passage dividing the second inlet passage into first and second portions communicating with the intake ports of the respective cylinder banks.

24. An induction system as set forth in claim 23 wherein the second inlet passage is offset from the center of the intake port in a direction away from the first intake passage.

25. An induction system as set forth in claim 22 further including a throttle valve in the first intake passage for controlling the flow therethrough, said throttle valve being positioned above the lowermost intake port and supported for rotation on a throttle valve shaft that extends through the first and second inlet passages.

26. An induction system as set forth in claim 25 further including a throttle valve position sensor affixed to the throttle valve shaft adjacent the second inlet passage.

27. An induction system as set forth in claim 22 further including an intake device communicating with the inlet opening and extending across the upper ends of the first and second inlet passages.

28. An induction system as set forth in claim 27 wherein the inlet device has a downwardly facing opening for receiving atmospheric air adjacent the upper end of the second inlet passage.

29. An induction system as set forth in claim 14 wherein there is provided a vertically extending dividing wall extending at least in part through the second inlet passage dividing the second inlet passage into first and second portions communicating with the intake ports of the respective cylinder banks.

30. An induction system as set forth in claim 29 wherein the second inlet passage is offset from the center of the intake port in a direction away from the first intake passage.

31. An induction system for a marine engine having at least one horizontally extending intake port, said induction system comprising a first generally vertically extending inlet passage having an inlet opening at its upper end for receiving atmospheric air, a second generally vertically extending inlet passage communicating at an upper portion thereof with said intake port, a U shaped section communicating the lower ends of said inlet passages with each other, and an intake device communicating with said inlet opening and extending across the upper ends of the first and second inlet passages.

32. An induction system as set forth in claim 31 wherein the inlet device has a downwardly facing opening for receiving atmospheric air adjacent the upper end of the second inlet passage.

33. An induction system as set forth in claim 31 wherein there are provided a multitude of inlet ports vertically spaced relative to each other and each communicating with the second inlet passage.

34. An induction system as set forth in claim 33 wherein the inlet ports are all formed at one end of the engine.

35. An induction system as set forth in claim 22 wherein the engine is a two cycle crankcase compression engine.

36. An induction system as set forth in claim 35 wherein the intake ports open into the crankcase chambers of the engine.

37. An induction system as set forth in claim 36 wherein the engine has a V configuration with multiple intake ports for each bank with the intake ports disposed in side by side vertically spaced orientation.

38. An induction system as set forth in claim 37 wherein there is provided a vertically extending dividing wall extending at least in part through the second inlet passage dividing the second inlet passage into first and second portions communicating with the intake ports of the respective cylinder banks.

39. An induction system as set forth in claim 38 wherein the second inlet passage is offset from the center of the intake port in a direction away from the first intake passage.

* * * * *

UNITED STATES PATENT AND TRADEMARK OFFICE

CERTIFICATE OF CORRECTION

PATENT NO. : 5,133,307

DATED : July 28, 1992

INVENTOR(S) : Noboru Kuihara

It is certified that error appears in the above-identified patent and that said Letters Patent is hereby corrected as shown below:

Column 7, line 6, Claim 35, "22" insert --34--.

Signed and Sealed this

Twelfth Day of October, 1993

*Attest:*

Bruce Lehman

BRUCE LEHMAN

*Attesting Officer*

*Commissioner of Patents and Trademarks*